United States Patent [19]

Attridge

[11] 3,958,091

[45] May 18, 1976

[54] SNAP-ACTION ELECTRIC SWITCH, AND CONTACT BLADE STRUCTURE THEREFOR

[76] Inventor: Ross R. Attridge, 616 Avenue Road, Suite No. 11, Toronto, Ontario, Canada

[22] Filed: Apr. 2, 1975

[21] Appl. No.: 564,444

[52] U.S. Cl. ..... 200/67 D; 200/67 DA; 200/175

[51] Int. Cl.[2] ..... H01H 13/36

[58] Field of Search ..... 200/67 D, 67 DA, 67 DB, 200/67 R, 175

[56] References Cited

UNITED STATES PATENTS 2,840,656 6/1958 Roeser ..... 200/67 DA

FOREIGN PATENTS OR APPLICATIONS 640,097 7/1950 United Kingdom..... 200/67 D

*Primary Examiner*—David Smith, Jr.

[57] ABSTRACT

In a snap-action electric switch, and a contact blade structure therefor, the contact blade of the contact blade structure is constituted by an actuation portion of approximately hollow rectangular form having two spaced limbs, a web at one end of the contact blade, and a further web at the other end of the contact blade, and a biassing portion which is disposed within the actuation portion and which is integral therewith by being connected to the first-metioned web of the actuation portion. A contact member is disposed between adjacent edge portions of the above-mentioned further web of the actuation portion and of the biassing portion, the biassing portion being of resultant cyma form to urge the contact member towards electrical contact with a terminal of the switch when the contact blade structure is operatively in use. An actuator member incorporated in the switch is operatively engageable with the limbs of the actuation portion of the contact blade for movement of the contact member into engagement with a second terminal of the switch, a slightly resiliently deformable cylindrical roller being disposed at the base of an inclined surface which is presented by the switch and which extends towards the above-mentioned one end of the contact blade, with the biassing portion of the contact blade at the junction between the double curves thereof in contact with the roller. Thus, the electric switch, and the contact blade structure therefor, are of simplified form, and substantially overcome the disadvantages which arise if the contact blade is constituted by two or more elements, if the contact blade incorporates bend lines, or if the contact member requires to be riveted to the contact blade.

10 Claims, 5 Drawing Figures

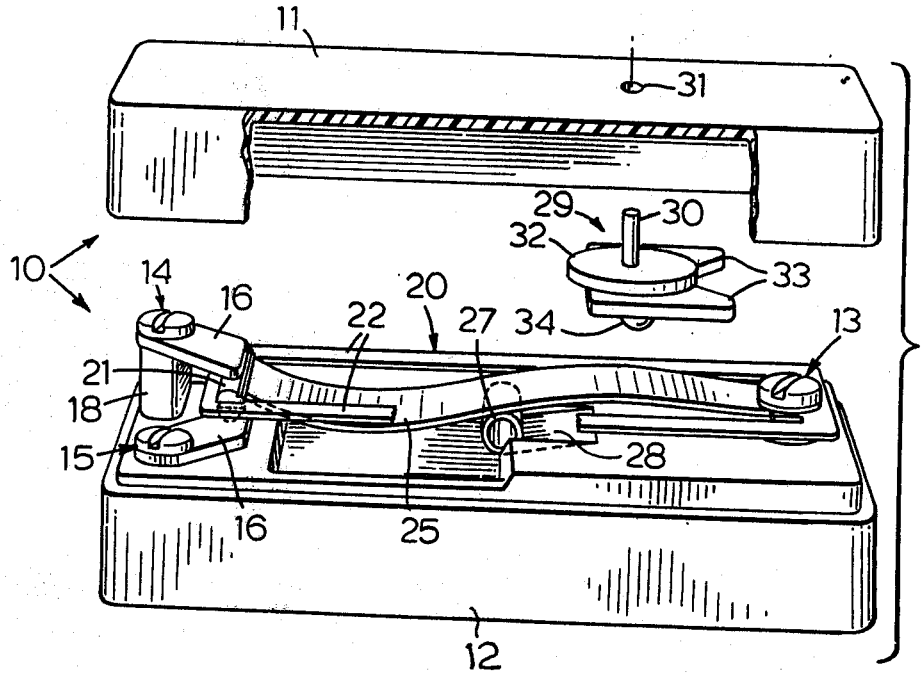
FIG. 1
FIG. 2
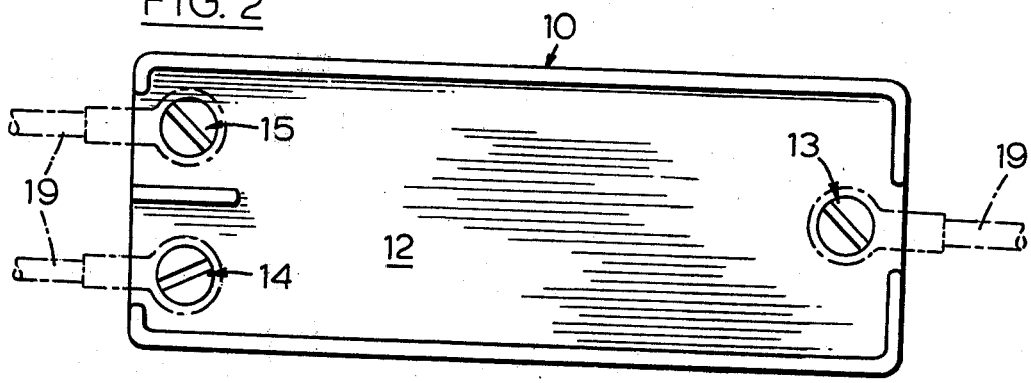
FIG. 3
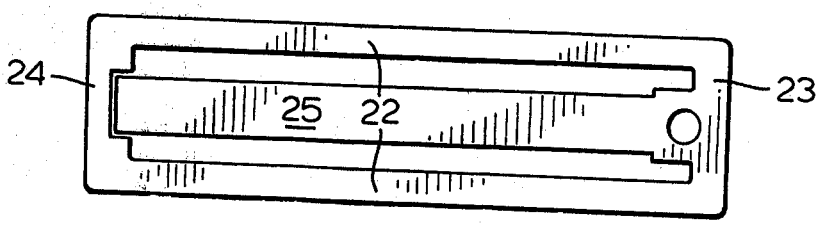

SNAP-ACTION ELECTRIC SWITCH, AND CONTACT BLADE STRUCTURE THEREFOR

This invention is concerned with a snap-action electric switch, and with a contact blade structure therefor, the switch being of the type comprising a housing, first, second and third terminals mounted and a contact blade structure which comprises a resilient, electrically conductive contact blade one end of which is fixedly mounted to the housing in electrical contact with the first terminal, and an electrically conductive contact member mounted on the other end of the contact blade in electrical contact therewith. The contact blade structure is moveable between a first position in which the contact member is in electrical contact with the second terminal and is spaced from the third terminal and a second position in which the contact member is in electrical contact with the third terminal and is spaced from the second terminal.

While many snap-action electric switches of this type as hitherto known function satisfactorily it is a disadvantage thereof that these switches, and particularly the contact blade structures thereof, are relatively expensive to manufacture and assemble. It is accordingly a primary object of the present invention to provide a snap-action electric switch, and a contact balde structure therefor, which is in relation to such switches and contact blade structures as hitherto known of improved and more particularly simplified form, and which is accordingly relatively inexpensive to manufacture and assemble.

According to the present invention in a snap-action electric switch of the type hereinbefore described the contact blade comprises an actuation portion, and a biassing portion which is integral with the actuation portion and is connected thereto at said one end of the contact blade, the contact member being disposed between the actuation portion and biassing portion at said other end of the contact blade, and the biassing portion being of resultant cyma form which urges the contact member towards electrical contact with the second terminal. A pivot member is provided with the biassing portion of the contact blade at the junction between the double curves thereof being in contact therewith, an actuator member being movably mounted in the housing and being engagable with the actuation portion of the contact blade for movement of the contact blade structure from said first position to said second position thereof.

Furthermore, according to the present invention a contact blade structure for a snap-action electric switch of the type hereinbefore described comprises a resilient, electrically conductive contact blade one end of which is fixedly mountable to the housing of the electric switch, and an electrically conductive contact member mounted on the other end of the contact blade in electrical contact therewith, the contact blade comprising an actuation portion and a biassing portion which is integral with the actuation portion and is connected thereto at said one end of the contact blade, and the contact member being disposed between the actuation portion and the biassing portion at said other end of the contact blade, whereby the biassing portion is of resultant cyma form.

In order that the invention may be more clearly understood and more readily carried into effect the same will now, by way of example, be more fully described with reference to the accompanying drawings in which FIG. 1 is an exploded, and partially broken-away view of a snap-action electric switch according to a preferred embodiment of the invention;

FIG. 2 is a bottom plan view of the switch illustrated in FIG. 1 showing in chain-dotted lines the electrical connections thereto;

FIG. 3 is a plan view showing an intermediate stage in the production of the contact blade structure incorporated in the electric switch shown in FIGS. 1 and 2;

Figure 4:
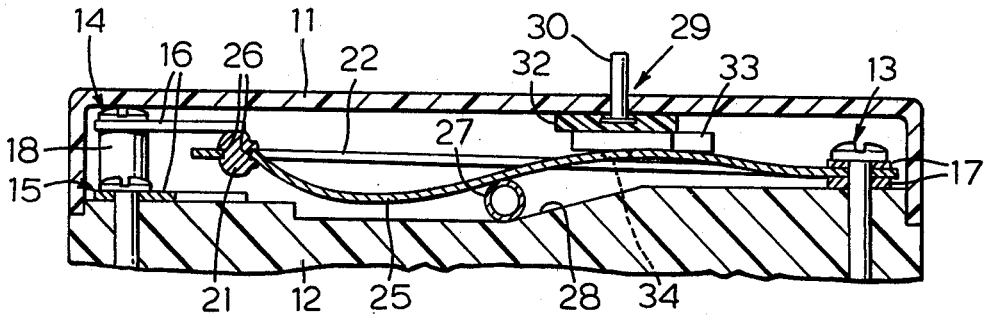
FIG. 4 is a partial side view, in section, of the electric switch illustrated in FIGS. 1 and 2, showing the switch in a first operative condition.

Referring to the drawings, 10 denotes generally a housing which is formed of an electrically insulating material and which comprises an upper portion 11 and a lower portion 12. These portions 11 and 12 may be formed of moulded plastics material and are operatively interconnectible in any convenient manner.

Mounted in the housing 10 and more particularly on the lower portion 12 thereof are first, second and third terminals which are denoted generally by the reference numerals 13, 14 and 15, respectively, each of these terminals 13, 14 and 15 comprising a screw-threaded member which is threadedly mounted in the lower portion 12 of the housing 10, with the terminals 14 and 15 also comprising projecting, electrically conductive members 16 which are so disposed, as is most clearly shown in FIG. 1, that the end portion of the member 16 of the terminal 14 remote from the screw-threaded member thereof is in vertically spaced relationship directly above the end portion of the member 16 of the terminal 15 remote from the screw-threaded member thereof. 17 denotes spacer washers incorporated in the first terminal 13, and 18 denotes a spacer washer incorporated in the second terminal 14.

When the electric switch is in use the first terminal 13, the second terminal 14 and the third terminal 15 are electrically connected to electrical leads which are shown in chain-dotted lines in FIG. 2 and are denoted by the reference numeral 19.

A resilient, electrically conductive contact blade which is denoted generally by the reference numeral 20 and which may be formed of a beryllium copper alloy is provided, one end of this contact blade 20 being operatively fixedly mounted to the housing 10, and more particularly to the lower portion 12 thereof, in electrical contact with the first terminal 13 by, for example, being secured to this lower portion 12 of the housing 10 by means of the screw-threaded member of the first terminal 13. Mounted on the other end of the contact blade 18 is an electrically conductive contact member 21 which is in electrical contact with the contact blade 20 and which may, for example, be formed of a silver cadmium alloy, or of brass with a silver cadmium alloy coating, the contact blade 20 and the contact member 21 together constituting a contact blade structure.

The contact blade 20 comprises an actuation portion which in the preferred embodiment of the invention shown in the accompanying drawings is of approximately hollow rectangular form comprising two spaced limbs 22, a web 23 at said one end of the blade 20, and a further web 24 at said other end of the blade 20. The contact blade 20 also comprises a biassing portion 25 which is integral with the actuation portion comprising the limbs 22 and the webs 23, 24 and which is connected thereto at said one end of the blade 20. Thus with reference to the preferred embodiment shown in the drawings, the biassing portion 25 is connected to the web 23, the biassing portion 25 being disposed within the actuation portion comprising the limbs 22 and the webs 23, 24.

FIG. 3 shows in plan view the contact blade 20 as hereinbefore described, the blade preferably being so formed by a stamping operation.

The contact member 21 is disposed between the actuation portion, and more particularly the web 24 thereof, and the biassing portion 25, at said other end of the blade 20. More particularly, the contact member 21 is provided with opposed grooves 26 within which are engaged the adjacent edge portions of the web 24 and of the biassing portion 25, so that the contact member 21 is thus resiliently retained between these adjacent edge portions. In so disposing the contact member 21 the biassing portion 25 of the contact blade 20 is deflected into a resultant cyma form which, with the contact blade structure operatively assembled in the electric switch, so urges the contact member 21 which is disposed between the above-mentioned vertically spaced end portions of the members 16 of the second and third terminals 14 and 15, respectively, towards electrical contact with the second terminal 14. Grooves which communicate with the grooves 26 and within which the edge portions of the actuation portion of the junctions of the limbs 22 with the web 24 are engaged are provided in the end faces of the contact member 21.

The junction between the double curves of the biassing portion 25 of cyma form is in contact with a pivot member 27, this pivot member 27 in the preferred embodiment shown in the accompanying drawings being constituted by a cylindrical roller disposed at the base of an inclined surface 28 which is presented by the lower portion 12 of the housing 10 and which extends in the direction towards said one end of the contact blade 20. The roller 27 is preferably slightly resiliently deformable by, for example, being formed of an appropriately tempered steel material.

An actuator member which is denoted generally by the reference numeral 29 is provided for causing movement, as hereinafter more fully explained, of the contact blade structure between a first position in which the contact member 21 is in electrical contact with the second terminal 14 and is spaced from the third terminal 15, and a second position in which the contact member 21 is in electrical contact with the third terminal 15 and is spaced from the second terminal 14. In the preferred embodiment shown in the drawings the actuator member 29 comprises a pin 30 which operatively projects through an aperture 31 provided in the upper portion 11 of the housing 10, a disc portion 32 to which the end of the pin 30 disposed within the housing 10 is secured, and two side portions 33 which are presented by the disc portion 32 and which straddle the biassing portion 25 of the contact blade 20, each of these side portions 33 presenting an actuating projection 34, with these actuating projections 34 being operatively engageable with the actuation portion, and more particularly the limbs 22, of the contact blade 20 to cause movement of the contact blade structure from the first position to the second position thereof, as is hereinafter more fully described.

With the electric switch initially in the first condition thereof shown in FIG. 4 in which the contact blade structure is in the first position thereof, it will be appreciated that the first terminal 13 is electrically connected to the second terminal 14 but is electrically disconnected from the thrid terminal 15. Furthermore, with the switch in this first condition thereof the cyma form of the biassing portion 25 of the contact blade 20 exerts a force on the contact member 21 to retain this contact member 21 in electrical contact with the second terminal 14. As a force is applied to the pin 30 of the actuator member 29 by an external mechanism (not shown) with which the electric switch is operatively associated a resultant force is exerted by the limbs 22 of the contact blade 20 on the contact member 21 to urge the contact member 21 in the direction away from the second terminal 14 towards the third terminal 15. Once this latter force acting on the contact member 21 exceeds the above-mentioned force urging the contact member 21 into electrical contact with the second terminal 14, the contact member 21 commences to move away from the second terminal 14 towards the third terminal 15. This movement of the contact member 21 results in a rapid reduction in the force exerted on the contact member 21 by the biassing portion 25 of the contact blade 20 so that the contact member 21 thereupon moves rapidly with a snap-action into electrical contact with the third terminal 15. The switch is then in the second condition thereof in which the contact blade structure is in its second position, as shown in FIG. 5.

Thereafter, as the force exerted by the external mechanism (not shown) to cause depression of the pin 30 of the actuator member 29 is reduced the contact member 21 remains in electrical contact with the third terminal 15 until the force exerted on the contact member 21 under the influence of the action of the actuator member 29 on the limbs 22 of the contact blade 20 is less than the force exerted on the contact member 21 by the biassing portion 25 of the contact blade 20, whereupon the contact member 21 commences to move away from the third contact 15 towards the second contact 14. This movement results in a rapid increase in the force exerted by the biassing portion 25 of the contact blade 20 on the contact member 21 with the result that the contact member 21 moves rapidly with a snap-action back into electrical contact with the second terminal 14.

Figure 5:
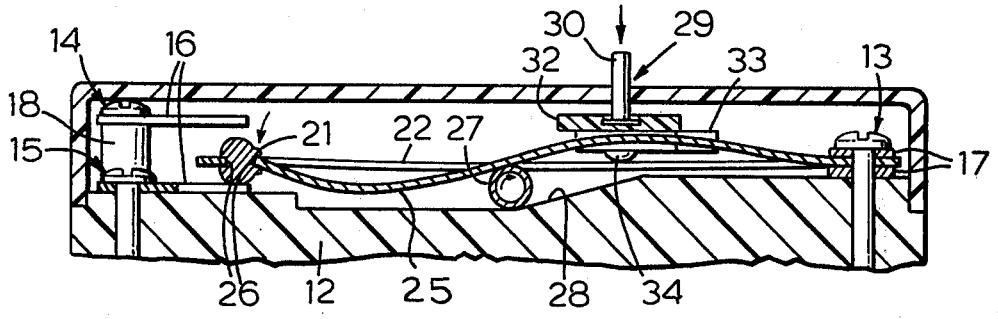
FIG. 5 is a view corresponding to FIG. 4, but showing the switch in a second operative condition.

During the above-described movement of the contact blade structure from the first position to the second position thereof the roller 27 is caused slightly to roll up the inclined surface 28 i.e. is caused slightly to roll in the direction of the arrow shown in FIG. 5, as the junction between the double curves of the biassing portion 25 of the contact blade 20 moves slightly towards the said one end of the contact blade 20. Likewise, during the above-described movement of the contact blade structure from the second position to the first position thereof the roller 27 is caused slightly to roll back down the inclined surface 28 to the base thereof, as the junction between the double curves of the biassing portion 25 of the contact blade 20 moves slightly towards the said other end of the contact blade 20 back to its original position. The slight resilient deformability of the roller 27 tends to prevent "dead-breaking" or chattering of the contact member 21 where the switch operation as hereinbefore described in extremely slow or where the switch is operatively subjected to vibration, respectively.

The "differential movement" of an electric switch according to the present invention may be of the order of five thousandths of an inch, this "differential movement" which is a measure of the sensitivity of the switch being defined as the distance through which the actuator member 29 operatively moves for movement of the contact blade structure from the second to the first positions thereof.

Thus, the present invention provides a snap-action electric switch, and a contact blade structure therefor, in which the contact blade 20 is integrally formed, thereby avoiding the increased manufacturing and assembly costs which arise where the contact blade is constituted by two or more elements, as is the case in certain contact blades as hitherto known. Furthermore, it will be noted that in the contact blade 20 according to the present invention it is unnecessary for any bend lines to be incorporated therein. This is advantageous since such bend lines can result in distortion during heat treatment of the contact blade.

It will also be noted that according to the present invention the contact member 21 does not require to be riveted to the contact blade 20, as is the case in certain contact blades as hitherto known. This is again an advantageous feature since certain materials of which the contact member may be formed are difficult to rivet so that if the contact member is to be riveted to the contact blade the choice of materials for the contact member is restricted. In addition, since as hereinbefore stated the contact member 21 may, for example, be formed of brass with a silver cadmium alloy coating the additional expense which would be involved if this contact member 21 was formed in its entirety of silver may be avoided.

What I claim as my invention is:

1. A snap-action electric switch comprising a housing, first, second and third terminals mounted in the housing, and a contact blade structure which comprises a resilient, electrically conductive contact blade one end of which is fixedly mounted to the housing in electrical contact with the first terminal, and an electrically conductive contact member mounted on the other end of the contact blade in electrical contact therewith, the contact blade structure being movable between a first position in which the contact member is in electrical contact with the second terminal and is spaced from the third terminal and a second position in which the contact member is in electrical contact with the third terminal and is spaced from the second terminal, wherein the contact blade comprises an actuation portion, and a biassing portion which is integral with the actuation portion and is connected thereto at said one end of the contact blade, the contact member being disposed between the actuation portion and the biassing portion at said other end of the contact blade, the biassing portion being of resultant cyma form which urges the contact member towards electrical contact with the second terminal, a pivot member being provided with the biassing portion of the contact blade at the junction between the double curves thereof being in contact therewith, and an actuator member being movably mounted in the housing and being engageable with the actuation portion of the contact blade for movement of the contact blade structure from said first portion to said second position thereof.

2. An electric switch according to claim 1, wherein the actuation portion of the contact blade is of approximately hollow rectangular form and comprises two spaced limbs, a web at said one end of the contact blade, and a further web at said other end of the contact blade, the biassing portion of the contact blade being disposed within the actuation portion thereof, with the contact member between said further web of the actuation portion and the biassing portion at said other end of the contact blade.

3. An electric switch according to claim 2, wherein the contact member is provided with opposed grooves within which are engaged adjacent edge portions of said further web of the actuation portion and of the biassing portion at said other end of the contact blade.

4. An electric switch according to claim 1, wherein the contact blade is of beryllium copper alloy.

5. An electric switch according to claim 1, wherein the pivot member comprises a cylindrical roller, the housing being provided with an inclined surface extending in the direction towards said one end of the contact blade, with the roller disposed at the base of said inclined surface.

6. An electric switch according to claim 1, wherein the pivot member is slightly resiliently deformable.

7. A contact blade structure for a snap-action electric switch, the contact blade structure comprising a resilient, electrically conductive contact blade one end of which is fixedly mountable to a housing of the electric switch, and an electrically conductive contact member mounted on the other end of the contact blade in electrical contact therewith, wherein the contact blade comprises an actuation portion, and a biassing portion which is integral with the actuation portion and is connected thereto at said one end of the contact blade, the contact member being disposed between the actuation portion and the biassing portion at said other end of the contact blade, whereby the biassing portion is of resultant cyma form.

8. A contact blade structure according to claim 7, wherein the actuation portion of the contact blade is of approximately hollow rectangular form and comprises two spaced limbs, a web at said one end of the contact blade, and a further web at said other end of the contact blade, the biassing portion of the contact blade being disposed within the actuation portion thereof, with the contact member between said further web of the actuation portion and the biassing portion at said other end of the contact blade.

9. A contact blade structure according to claim 8, wherein the contact member is provided with opposed grooves within which are engaged adjacent edge portions of said further web of the actuation portion and of the biassing portion at said other end of the contact blade.

10. A contact blade structure according to claim 7, wherein the contact blade is of beryllium copper alloy.

* * * * *